US006779500B2

(12) United States Patent
Kanada et al.

(10) Patent No.: US 6,779,500 B2
(45) Date of Patent: Aug. 24, 2004

(54) VARIABLE VALVE TIMING CONTROL APPARATUS

(75) Inventors: Yoji Kanada, Gamagori (JP); Osamu Komazawa, Chita (JP); Hiroshi Kubo, Anjo (JP); Kazuhiko Maeda, Anjo (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/177,676

(22) Filed: Jun. 24, 2002

(65) Prior Publication Data

US 2003/0010303 A1 Jan. 16, 2003

(30) Foreign Application Priority Data

Jun. 28, 2001 (JP) ..... 2001-197372

(51) Int. Cl.[7] ..... F01L 1/34

(52) U.S. Cl. ..... 123/90.17; 123/90.15; 74/568 R

(58) Field of Search ..... 123/90.12, 90.15, 123/90.16, 90.17; 464/1, 2, 160, 90.31; 74/568 R

(56) References Cited

U.S. PATENT DOCUMENTS 5,957,098 A * 9/1999 Fukuhara et al. ..... 123/90.17
6,035,819 A * 3/2000 Nakayoshi et al. ..... 123/90.17
6,053,138 A 4/2000 Trzmiel et al.
6,053,139 A * 4/2000 Eguchi et al. ..... 123/90.17
6,058,897 A * 5/2000 Nakayoshi ..... 123/90.17
6,386,164 B1 * 5/2002 Mikame et al. ..... 123/90.17
6,553,951 B2 * 4/2003 Ogawa ..... 123/90.17

FOREIGN PATENT DOCUMENTS

| | | |
|---|---|---|
| DE | 197 56 017 A1 | 6/1999 |
| EP | 0 857 859 A1 | 8/1998 |
| EP | 0 924 382 A2 | 6/1999 |
| JP | 2001-41012 A | 2/2001 |

* cited by examiner

*Primary Examiner*—Thomas Denion
*Assistant Examiner*—Jaime Corrigan
(74) *Attorney, Agent, or Firm*—Burns, Doane, Swecker & Mathis, L.L.P.

(57) ABSTRACT

A variable valve timing control apparatus includes a relative rotation control mechanism and a fluid pressure passage. The relative rotation control mechanism restrains a relative rotation between a rotor and a housing at an intermediate phase position between the most advanced angle phase position and the most retarded angle phase position. The fluid pressure passage includes a first fluid path for supplying the fluid to the relative rotation control mechanism and for draining the fluid therefrom and a second fluid path for supplying the fluid to an advance angle chamber and a retard angle chamber and for draining the fluid therefrom. The first fluid path is defined independently of the second fluid path.

12 Claims, 11 Drawing Sheets

VARIABLE VALVE TIMING CONTROL APPARATUS

CROSS REFERENCE TO RELATED APPLICATIONS

This application is based on and claims priority under 35 U.S.C. § 119 with respect to a Japanese Patent Application 2001-197372, filed on Jun. 28, 2001, the entire content of which is incorporated herein by reference.

FIELD OF THE INVENTION

This invention generally relates to a variable valve timing control apparatus for controlling an opening/closing timing of a valve of an internal combustion engine.

BACKGROUND OF THE INVENTION

A Japanese Patent Laid-open Application No. 2001-41012 discloses a variable valve timing control apparatus which is provided with a housing, a vane body, an oil pressure control device, and an intermediate position lock pin. The housing is connected to one of a cam shaft of an internal combustion engine and a crank shaft thereof and includes walls radially formed at an interior of the housing. The walls define the interior of the housing into spaces. The vane body is connected to the other one of the cam shaft and the crank shaft and is rotatably disposed in the interior of the housing. The vane body is provided with radially formed vanes for defining each defined space into an advance angle chamber and a retard angle chamber. The oil pressure control device controls an oil pressure to be supplied to the advance angle chamber and the retard angle chamber so as to rotate the vane body relative to the housing. A relative rotational phase between the crank shaft and the cam shaft can be hence varied in response to the rotation of the vane body relative to the housing. The intermediate position lock pin is equipped to the vane body and is projected from the vane body so as to be engaged with an engaging bore defined in the housing when a pressure level in the chambers is lower than a predetermined pressure level. The vane body is then locked by the intermediate position lock pin at an intermediate position between the most advanced angle phase position of the vane body relative to the housing and the most retarded angle phase position thereof relative to the housing.

However, according to the above described variable valve timing control apparatus, the oil for releasing the intermediate position lock pin from the engaging bore is supplied to a pressure receiving surface of the intermediate position lock pin either from the advance angle chamber via a hydraulic passage or from the retard angle chamber via the other hydraulic passage. Accordingly, when restarting the internal combustion engine immediately after being stopped, the intermediate position lock pin may be engaged with the engaging bore so as to maintain the vane body at the intermediate position under the state where the advance angle chamber (or the retard angle chamber) has been filled with the oil. When the vane body is rotated due to a variable torque applied from the cam shaft under the above condition, the volume of the advance angle chamber (or the retard angle chamber) is varied. When the volume of the advance angle chamber (or the retard angle chamber) is decreased, the oil pressure level in the advance angle chamber (or the retard angle chamber) is temporarily increased. On the other hand, when the volume thereof is increased, the oil pressure level therein is returned down to the former oil pressure level. The variation of the oil pressure level acts on the pressure receiving surface of the intermediate position lock pin from the advance angle chamber (or from the retard angle chamber) via the hydraulic passage. Therefore, an operation of the intermediate position lock pin to be engaged with the engaging bore and to be disengaged therefrom is repeatedly performed.

As a result of this, when the variable torque is applied to the vane body before the intermediate position lock pin, which has been disengaged from the engaging bore, is engaged with the engaging bore, the vane body may be rotated relative to the housing. In other words, the phase of the vane body relative to the housing can not be maintained at the intermediate position by the intermediate position lock pin.

Accordingly, the above disclosed variable valve timing control apparatus is still susceptible of certain improvements with respect to assuring the engagement of the intermediate position lock pin with the engaging bore of the housing even when the oil pressure level variation occurs in the advance angle chamber (or the retard angle chamber) due to the variable torque from the cam shaft.

SUMMARY OF THE INVENTION

According to a first aspect of the present invention, a variable valve timing control apparatus includes a housing integrally rotated with one of a crank shaft of an internal combustion engine and a cam shaft thereof, a rotor provided in the housing and integrally rotated with the other one of the crank shaft and the cam shaft, a hydraulic chamber defined between the housing and the rotor, a vane assembled in the rotor for dividing the hydraulic chamber into an advance angle chamber and a retard angle chamber, a relative rotation control mechanism for restraining a relative rotation between the rotor and the housing at an intermediate phase position between the most advanced angle phase position and the most retarded angle phase position in response to a fluid supplied to the relative rotation control mechanism and a fluid drained therefrom, and a fluid pressure passage for controlling the fluid supplied to the advance angle chamber, the retard angle chamber, and the relative rotation control mechanism and for controlling the fluid drained therefrom Further, the fluid pressure passage includes a first fluid path for supplying the fluid to the relative rotation control mechanism and for draining the fluid therefrom independently of a second fluid path for supplying the fluid to the advance angle chamber and the retard angle chamber and for draining the fluid therefrom.

Therefore, the fluid supplied to the relative rotation control mechanism and drained therefrom can be controlled regardless of the fluid supplied to the advance angle chamber or the retard angle chamber and drained therefrom.

According to a second aspect of the present invention, the fluid pressure passage further includes a hydraulic pressure control valve for supplying the fluid to the advance angle chamber, the retard angle chamber, and the relative rotation control mechanism and for draining the fluid therefrom. The hydraulic pressure control valve includes a third fluid path for supplying the fluid to the relative rotation control mechanism and for draining the fluid therefrom independently of a fourth fluid path for supplying the fluid to the advance angle chamber and the retard angle chamber and for draining the fluid therefrom.

Therefore, the fluid can be supplied to and/or drained from the relative rotation control mechanism independently of the fluid supplied to and/or drained from the advance angle chamber and the retard angle chamber.

BRIEF DESCRIPTION OF THE DRAWING FIGURES

The foregoing and additional features and characteristics of the present invention will become more apparent from the following detailed description considered with reference to the accompanying drawing figures wherein.

DETAILED DESCRIPTION OF THE INVENTION

Figure 1:
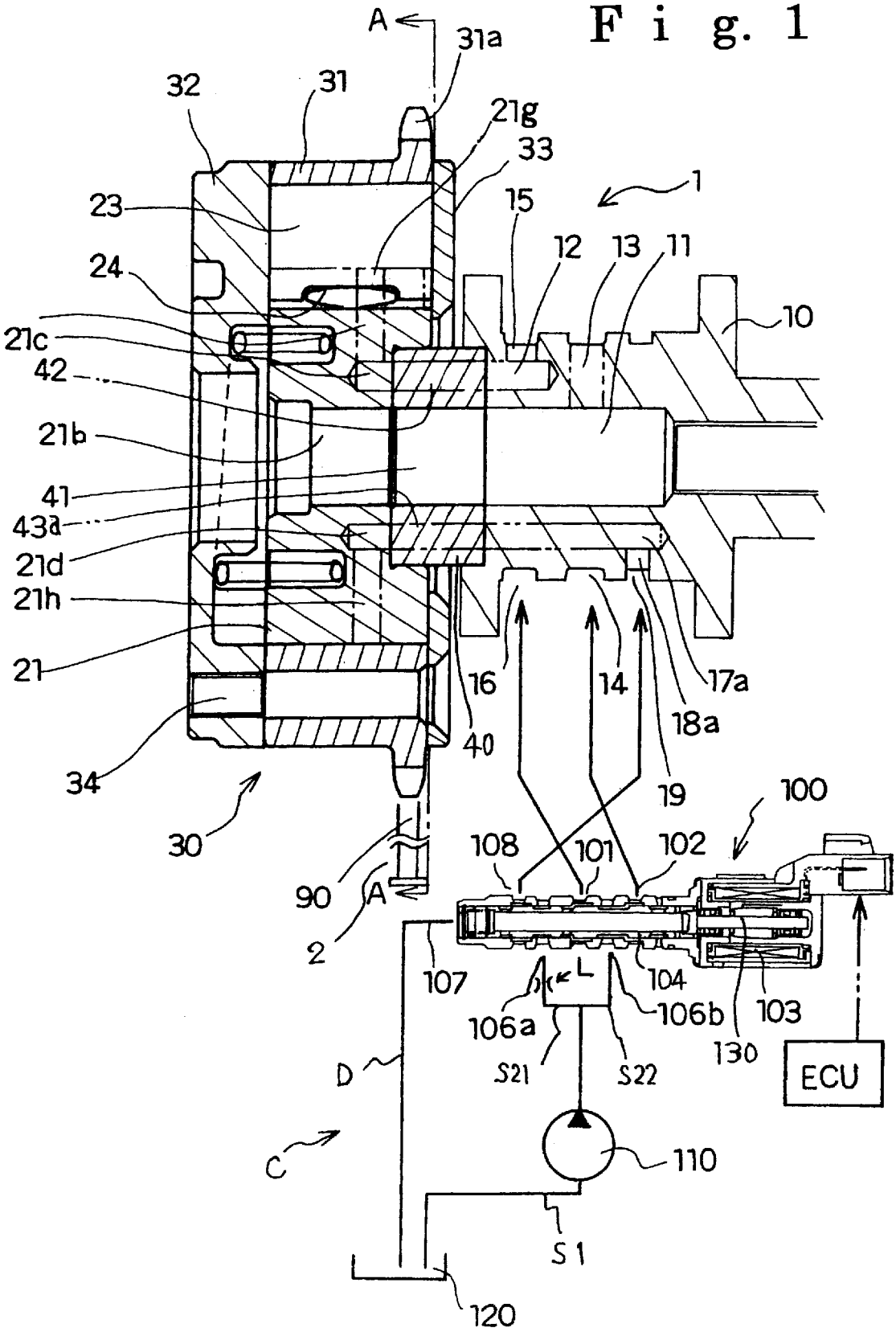
FIG. 1 illustrates an entire structure of a variable valve timing control apparatus according to a first embodiment of the present invention.

Hereinafter, a variable valve timing control apparatus according to a first embodiment of the present invention is described with reference to drawings. Hatching lines in FIG. 2 are omitted for simplifying the drawing.

Figure 2:
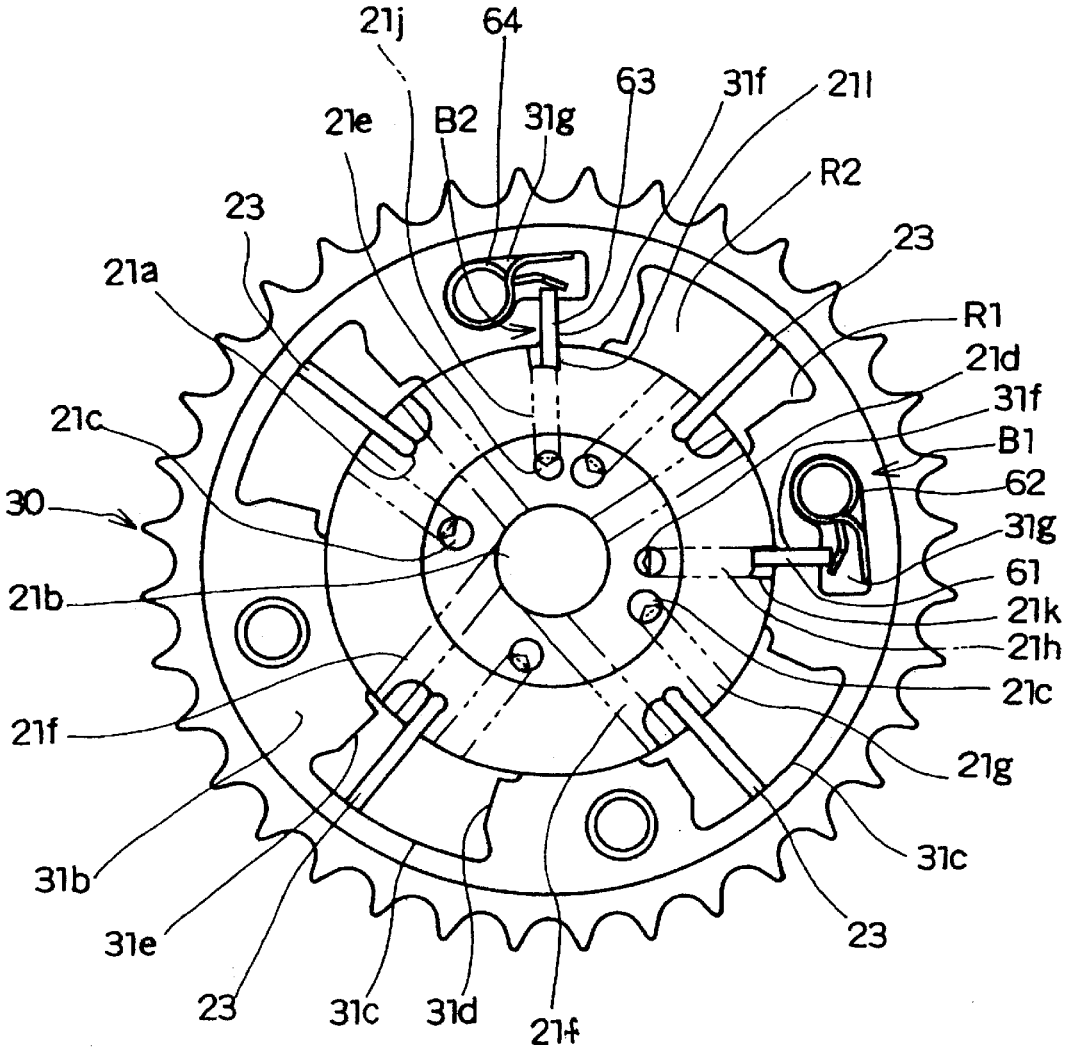
FIG. 2 is a cross-sectional view of the variable valve timing control apparatus illustrated in FIG. 1.

The variable valve timing control apparatus according to the first embodiment of the present invention illustrated in FIGS. 1, 2 is mainly provided with a rotor 21, a connector 40, a housing 30, a transmitting member 90, a first control mechanism B1, a second control mechanism B2, and a hydraulic pressure control valve 100. The rotor 21 and the connector 40 are integrally assembled to a tip end portion of a cam shaft (a driven shaft) 10 by means of a volt (not shown). The connector 40 is disposed between each opposing end surface of the cam shaft 10 and the rotor 21 so as to connect the cam shaft 10 and the rotor 21. The rotor 21 is screwed integrally with a tip end of the connector 40. The housing 30 is disposed at an outer side of the rotor 21 to be rotated relative to the rotor 21. The rotational force of a crank shaft (a rotational shaft) 2 of an internal combustion engine (hereinafter, referred to as an engine) 1 is transmitted to the housing 30 via the transmitting member 90. According to the first embodiment of the present invention, a timing chain is applied to the transmitting member 90. Each first and second control mechanism B1, B2 serves as a relative rotation control mechanism for controlling a rotation of the rotor 21 relative to the housing 30. The hydraulic pressure control valve 100 controls oil (fluid) to be supplied to an advance angle chamber R1, a retard angle chamber R2 and to be drained therefrom. The hydraulic pressure control valve 100 further controls the oil (the fluid) to be supplied to the first, second control mechanisms B1, B2 and to be drained therefrom. The fluid is supplied to the advance angle chamber R1, the retard angle chamber R2, the first, second control mechanisms B1, B2, via a fluid pressure passage. The advance angle chamber R1 and the retard angle chamber R2 are described later.

The cam shaft 10 is equipped with a known cam (not shown) for performing an opening/closing operation of an intake valve (not shown) or an exhaust valve (not shown). The cam shaft 10 is rotatably supported by a cylinder head (not shown) of the engine 1. An advance oil path 11 and four retard oil paths 12 extend in the cam shaft 10 in an axial direction thereof. The advance oil path 11 is connected to an advance port 102 of the hydraulic pressure control valve 100 via a radial oil bore 13 and an annular oil path 14. Each retard oil path 12 is connected to a retard port 101 of the hydraulic pressure control valve 100 via a radial oil bore 15 and an annular oil path 16. Further, the cam shaft 10 is provided with axial oil paths 17*a*, 17*b* (17*b* is not shown), radial oil bores 18*a*, 18*b* (18*b* is not shown), and an annular oil path 19 therein. The oil paths 17*a*, 17*b* are defined in the cam shaft 10 independently of the advance oil path 11 and the retard oil path 12. As described later, the oil path 17*a*, the oil bore 18*a*, and the oil path 19 forms an oil path (a first fluid path of the fluid pressure passage) for supplying the oil to the first control mechanism B1. On the other hand, the oil path 17*b*, the oil bore 18*b*, and the oil path 19 forms an oil path (the first fluid path) for supplying the oil to the second control mechanism B2. The axial oil paths 17*a*, 17*b* communicate with the oil path 19 via the radial oil bores 18*a*, 18*b*, respectively. The annular oil path 19 is connected with a lock port 108 of the hydraulic pressure control valve 100.

An axial oil path 41 is defined in the connector 40 and communicates with the advance oil path 11. Four axial oil paths 42 are further defined in the connector 40 and communicate with four retard oil paths 12, respectively. Further, the other axial oil paths 43*a*, 43*b* (43*b* is not shown) are defined in the connector, 40 and communicate with the axial oil paths 17*a*, 17*b*, respectively. The rotor 21 includes a central inner bore 21*b* of which front end is closed by a head portion of a not-shown bolt. The central inner bore 21*b* communicates with the advance oil path 11 via the axial oil path 41 in the connector 40.

As illustrated in FIG. 2, the rotor 21 is provided with a vane groove 21*a* for assembling four vanes 23 and four springs 24 (as illustrated in FIG. 1) for biasing the vanes 23 in a radial direction of the rotor 21: The vanes 23 assembled in the vane groove 21*a* extend outwardly in the radial direction of the rotor 21 and define the four advance angle chambers R1 and the four retard chambers R2 in the housing 30. The rotor 21 is further provided with oil bores 21*c*, 21*d*, 21*e*. The oil bores 21*c* communicate with the retard oil paths 12 via the oil paths 42 axially defined in the connector 40. The oil bore 21*d* communicates with the oil path 17*a* axially defined in the cam shaft 10 via the oil path 43*a* axially defined in the connector 40. The oil bore 21*e* communicates with the oil path 17*b* axially defined in the cam shaft 10 via the oil path 43*b* (not shown) axially defined in the connector 40. The rotor 21 is further provided with four radial oil bores 21*f* and four radial oil bores 21*g*. The oil bores 21*f* communicate with the central inner bore 21*b* at an inner end in the radial direction of the rotor 21 and further communicate with the advance angle chamber R1 at an outer end in the radial direction thereof. The oil bores 21*g* communicate with the oil bores 21*c* at the inner end in the radial direction of the rotor 21 and further communicate with the retard angle chamber R2 at the outer end in the radial direction thereof. The rotor 21 is still further provided with radial oil bores 21*h*, 21*j*. The oil bore 21*h* communicates with the oil bore 21*d* at the inner end in the radial direction of the rotor 21 and further communicates with a lock groove 21*k* of the first control mechanism B1 at the outer end in the radial direction thereof. The oil hole 21*j* communicates with the oil hole 21*e* at the inner end in the radial direction of the rotor 21 and further communicates with a lock groove 21*l* of the second control mechanism B2 at the outer end in the radial direction thereof.

The housing 30 is formed of a housing body 31, a front plate 32, a rear thin plate 33 which all are integrally connected by means of a bolt 34. A sprocket 31*a* is integrally formed at a rear outer periphery of the housing body 31. As being known, the sprocket 31*a* is operatively connected to the crank shaft 2 of the engine 1 via the transmitting member 90, i.e. the timing chain 90. The sprocket 31*a* is operatively rotated in a counterclockwise direction in FIG. 2 corresponding to the driving force transmitted from the crank shaft 2. The housing body 31 is provided with four projecting portions 31*b* projecting toward the center in the radial direction of the housing body 31, whereby hydraulic chambers 31*c* are defined between each projecting portion 31*b*, respectively. A vane 23 is disposed in each hydraulic chamber 31*c* for defining the advance angle chamber R1 and the retard angle chamber R2. Axial end surfaces of the front plate 32 and the rear thin plate 33, which oppose to each other, are slidably in contact with axial end surfaces of the rotor 21 and axial end surfaces of the vanes 23, respectively. As illustrated in FIG. 2, one of the hydraulic chambers 31*c* includes a projection 31*d* (a first projection) for defining the most advanced angle phase position when the vane 23 comes in contact with the projection 31*d* and a projection 31*e* (a second projection) for defining the most retarded angle phase position when the vane 23 comes in contact with the projection 31*e*.

The first control mechanism B1 is unlocked when the oil is supplied thereto from the lock port 108 of the hydraulic pressure control valve 100 via the oil path 19, the oil bore 18*a*, the oil paths 17*a*, 43*a*, and the oil bores 21*d*, 21*h*. The second control mechanism B2 is unlocked when the oil is supplied thereto from the lock port 108 via the oil path 19, the oil bore 18*b*, the oil paths 17*b*, 43*b*, and the oil bores 21*e*, 21*j*. Accordingly, the rotation of the rotor 21 relative to the housing 30 can be allowed. In the meantime, as illustrated in FIG. 2, the first, second control mechanisms B1, B2 are locked when the oil is drained to the oil paths 17*a*, 17*b*, respectively. Therefore, the rotation of the rotor 21 relative to the housing 30 in an advance angle direction is restrained at the intermediate phase position between the most retarded angle phase position and the most advanced angle phase position. As described above, according to the first embodiment of the present invention, the first fluid path for supplying the fluid to the first, second control mechanisms B1, B2 and for draining the fluid therefrom are formed of the oil path 19, the oil bores 18*a*, 18*b*, the oil paths 17*a*, 17*b*, 43*a*, 43*b*, and the oil bores 21*d*, 21*e*, 21*h*, 21*j*.

The first control mechanism B1 is further provided with a lock plate 61, a lock spring 62 and the second control mechanism B2 is further provided with a lock plate 63, a lock spring 64. Each lock plate 61, 63 is assembled in each evacuation bore 31*f* radially defined in the housing body 31 so as to be slidably movable in the radial direction of the housing body 31. Each lock spring 62, 64 is accommodated in each accommodating portion 31*g*. Therefore, each lock plate 61, 63 is biased by each lock spring 62, 64 to be projected from each evacuation bore 31*f*. Each tip end portion of each lock plate 61, 63 can be slidably inserted into each lock groove 21*k*, 21*l* or evacuated therefrom. Therefore, the lock plates 61, 63 are moved in the radial direction against the biasing fore of the lock springs 62, 64 when the oil is supplied to the lock grooves 21*k*, 21*l* so as to be evacuated into the evacuation hole 31*f*. The tip ends of the lock plates 61, 63 can become in contact with the peripheral surface of the rotor 21. In this case, the rotor 21 can be rotated. Further, as illustrated in FIG. 2, tip ends at inner sides in the radial direction of the lock grooves 21*k*, 21*l* is matched with the evacuation holes 31*f* when the rotor 21 is at the intermediate phase position relative to the housing 30.

A torsion spring is disposed between the housing 30 and the rotor 21 for biasing the rotor 21 to be rotated in the advance angle direction relative to the housing 30. Therefore, the rotor 21 can be rotated in the advance angle direction relative to the housing 30 with a good response.

The hydraulic pressure control valve 100 illustrated in FIG. 1 forms an oil pressure circuit C having an oil pump 110 driven by the engine 1, an oil pan 120 thereof. Further, the hydraulic pressure control valve 100 is a variable electromagnetic spool valve for moving a spool 104 against a spring 105 in response to electric current supplied to a solenoid 103 by an electronic control unit (ECU). The ECU controls a duty value (%) of the electric current to be supplied to the solenoid 103 so as to change the stroke amount of a pushing member 130 for pushing the spool 104. The position of the spool 104 disposed in a sleeve 150 (as illustrated in FIG. 2) is hence changed resulting from the duty value control. Therefore, the oil supply to the advance oil path 11, the retard oil path 12, the first, second control mechanisms B1, B2 and the oil drain therefrom can be controlled. The oil pressure circuit C is formed of an oil path S1 connecting the oil pan 120 and the oil pump 110, an oil path S21 connecting an outlet port (not shown) of the oil pump 110 and a first supply port 106*a* (described later) of the hydraulic pressure control valve 100, an oil path S22 for connecting the outlet port of the oil pump 110 and a second supply port 106*b* (described later) of the hydraulic pressure control valve 100, and an oil path D connecting a drain port 107 and the oil pan 120. In this case, the fluid can be drained from the advance angle chamber R1 and the retard angle chamber R2 to the oil pan 120 via the drain port 107, the oil path D. Therefore, the fluid in each chamber R1 and R2 is not applied as a resistance against a rotation of the vane 23 in each chamber R1 and R2.

The oil pump 110 driven by the engine 1 supplies the oil from the oil pan 120 to the supply ports 106*a*, 106*b*. The oil can be circulated from the drain port 107 to the oil pan 120.

The ECU receives signals detected by various sensors including a crank angle, a cam angle, a throttle opening degree, an internal combustion engine rotational number, an internal combustion engine cooling water temperature, a vehicle speed. An output from the ECU, i.e. the duty value of the electric current supplied to the solenoid 103, can be controlled employing a predetermined control routine based upon the detected signals in response to the internal combustion engine driving condition.

Figure 5:
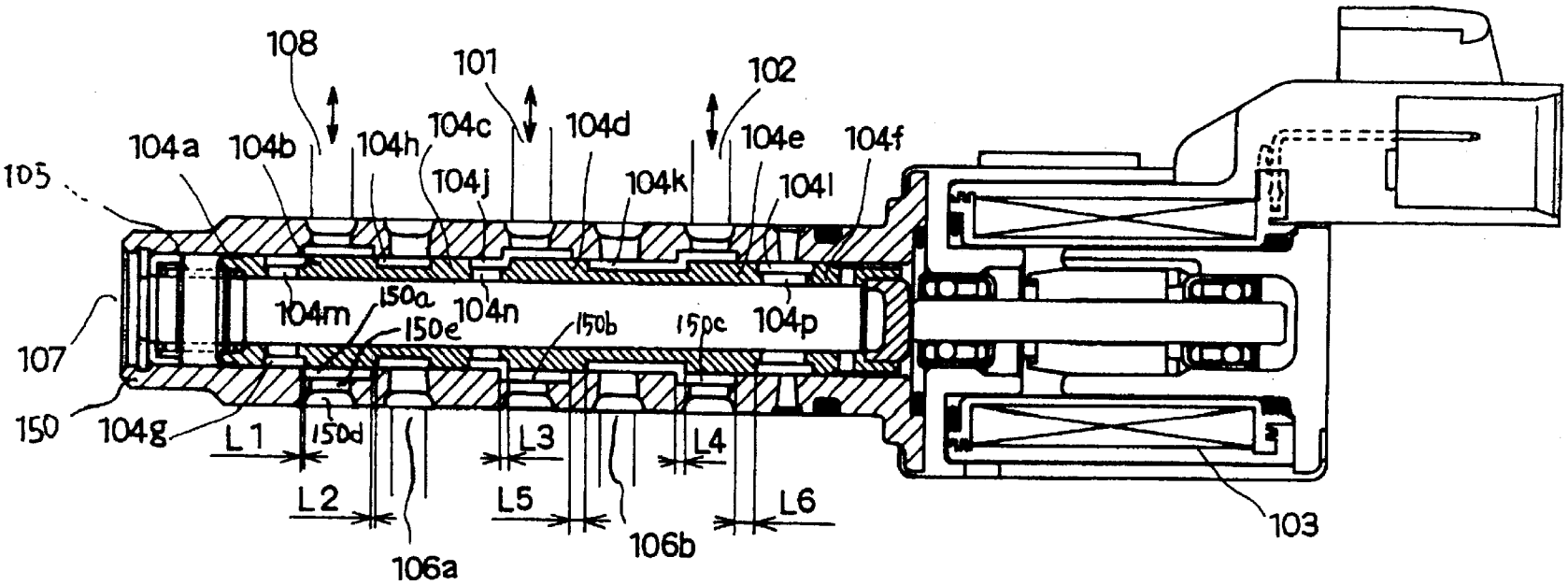
FIG. 5 is an enlarged view illustrating a first excited condition of a hydraulic pressure control valve according to the first embodiment of the present invention.

As being enlarged in FIG. 5, the spool 104 of the hydraulic pressure control valve 100 is provided with six land portions 104*a*, 104*b*, 104*c*, 104*d*, 104*e*, 104*f*, five annular grooves 104*g*, 104*h*, 104*j*, 104*k*, 104*l*, three annular grooves 150*a*, 150*b*, 150*c*, and connecting ports 104*m*, 104*n*, 104*p*. Each annular groove 104*g*, 104*h*, 104*j*, 104*k*, 104*l* is defined between each land portion. Each annular groove 150*a*, 150*b*, 150*c* is defined in the spool 150. Each connecting port 104*m*, 104*n*, 104*p* is defined for connecting each annular groove 104*g*, 104*j*, 104*l* and the drain port 107. A lap amount L1 between the annular groove 104*g* and the annular groove 150*a* is set to be equal to or smaller than a lap amount L2 between the annular groove 150*a* and the annular groove 104*h*. The lap amount L2 is set to be smaller than a lap amount L3 between the annular groove 104*j* and the annular groove 150*b*. The lap amount L3 is set to be equal to or smaller than a lap amount L4 between the annular groove 104*k* and the annular groove 150*c*. The lap amount L4 is set to be smaller than a lap amount L5 between the annular groove 150*b* and the annular groove 104*k*. The lap amount L5 is set to be equal to or smaller than a lap amount L6 between the annular groove 150*c* and the annular groove 104*l*. The fluid pressure passage further includes an oil path (a third fluid path) connected to the relative rotation control valve and an oil path (a fourth fluid path) connected to the advance angle chamber and the retard angle chamber in response to the position of the spool 104.

When the spool 104 is positioned as illustrated in FIG. 5, i.e. when the solenoid 103 is under a excited condition with the duty ratio of 0%, the communication between the first supply port 106*a* and the lock port 108 is interrupted by the land portion 104*b*. The communication between the second supply port 106*b* and the retard port 101 is interrupted by the land portion 104*d*, and yet the communication between the second supply port 106*b* and the advance port 102 is established by the land portion 104*e*. The lock port 108 can be allowed to communicate with the drain port 107 via the annular groove 104*g* and the connecting port 104*m* by means of the land portion 104*b*. The retard port 101 can be also allowed to communicate with the drain port 107 via the annular groove 104*j* and the connecting port 104*n* by means of the land portion 104*d*. Therefore, the oil can be drained from the retard port 101, the lock port 108, the lock groove 21*k* of the first control mechanism B1, the lock groove 21*l* of the second control mechanism B2, and the retard angle chamber R2. On the other hand, the advance angle chamber R1 can be supplied with the oil.

Figure 6:
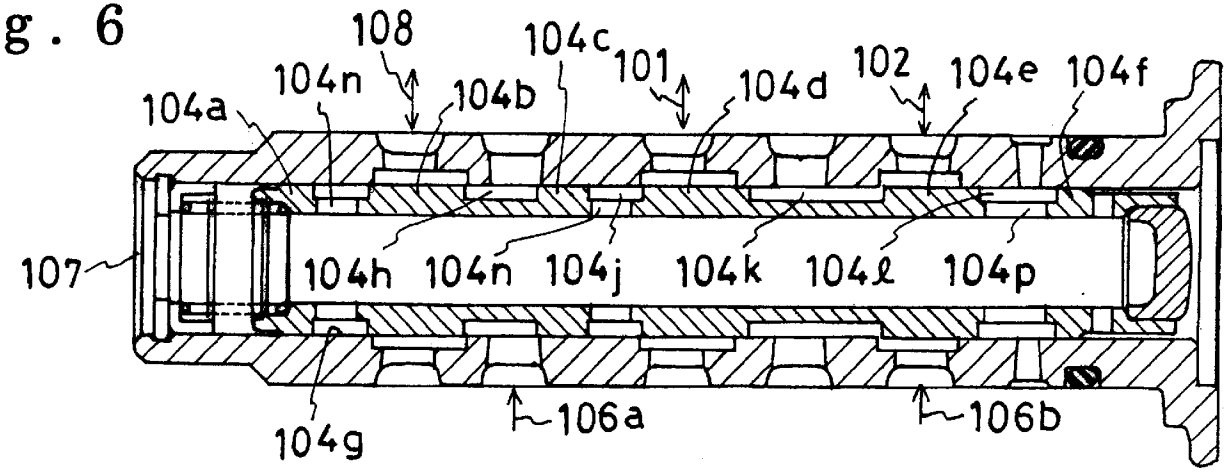
FIG. 6 is an enlarged view illustrating a second excited condition of the hydraulic pressure control valve according to the first embodiment of the present invention.

When the spool 104 is positioned as illustrated in FIG. 6, the communication between the first supply port 106*a* and the lock port 108 can be established by the land portion 104*b*. The communication between the lock port 108 and the drain port 107 is interrupted by the land portion 104*b*. The communication between the second supply port 106*b* and the retard port 101 is interrupted by the land portion 104*d*. The communication between the second supply port 106*b* and the advance port 102 can be established by the land portion 104*e*. The retard port 101 is allowed to communicate with the drain port 107 via the annular groove 104*j* and the connecting port 104*n* by means of the land portion 104*d*. Therefore, the lock grooves 21*k*, 21*l* of the first, second control mechanisms B1, B2 and the advance angle chamber R1 can be supplied with the oil. On the other hand, the oil can be drained from the retard angle chamber R2.

Figure 7:
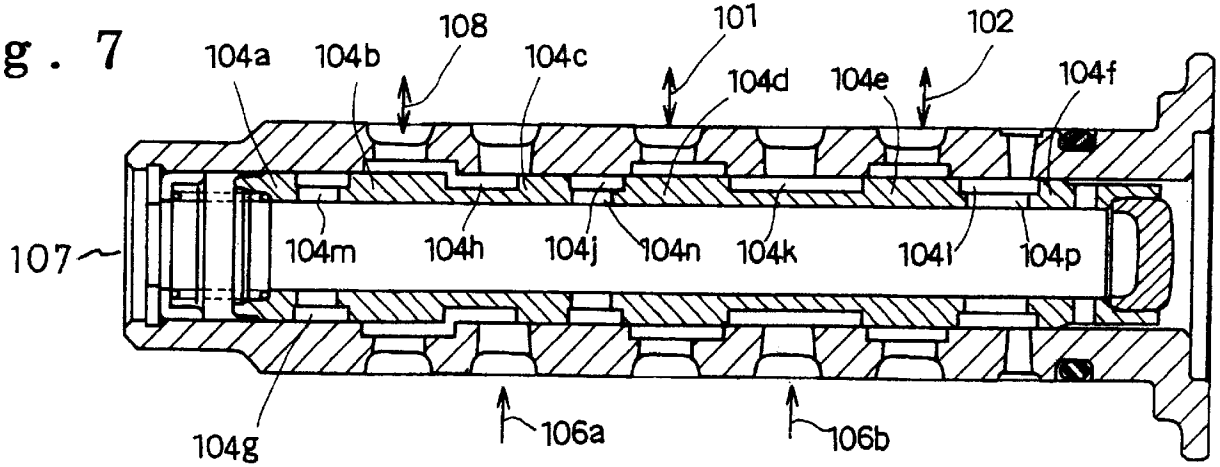
FIG. 7 is an enlarged view illustrating a third excited condition of the hydraulic pressure control valve according to the first embodiment of the present invention.

When the spool 104 is positioned as illustrated in FIG. 7, the communication between the first supply port 106*a* and the lock port 108 can be established by the land portion 104*b*. The communication between the second supply port 106*b* and the retard port 101 is interrupted by the land portion 104*d*. The communication between the second supply port 106*b* and the advance port 102 is also interrupted by the land portion 104*e*. The communication between the retard port 101 and the drain port 107 is interrupted by the land portion 104*d* and the communication between the advance port 102 and the drain port 107 is interrupted by the land portion 104*e*. Therefore, the lock grooves 21*k*, 21*l* of the first, second control mechanisms B1, B2 can be supplied with the oil. The supply of the oil to the chambers R1, R2 and the drain of the oil therefrom are interrupted.

Figure 8:
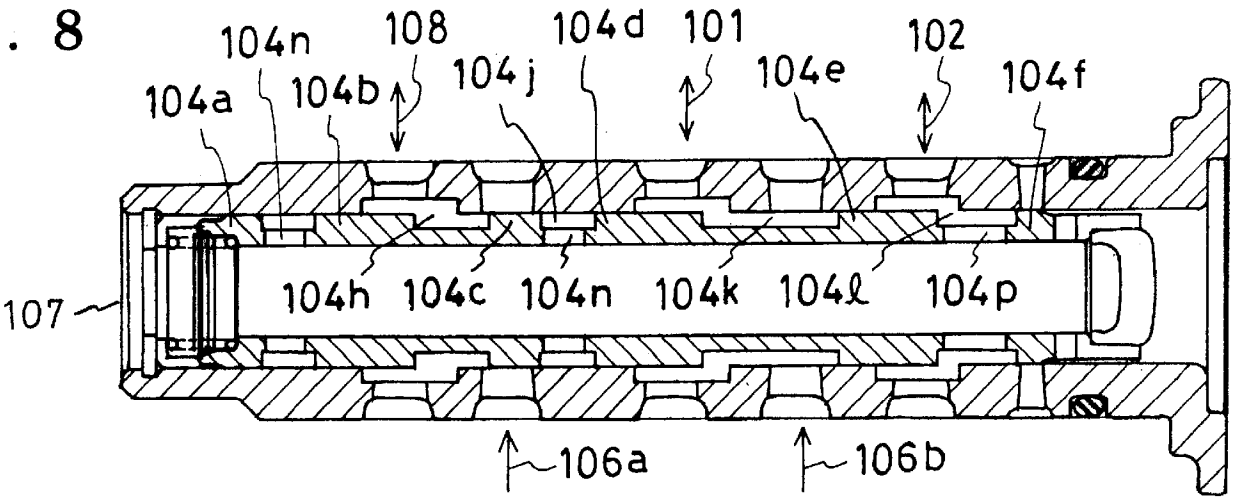
FIG. 8 is an enlarged view illustrating a fourth excited condition of the hydraulic pressure control valve according to the first embodiment of the present invention.

When the spool 104 is positioned as illustrated in FIG. 8, the first supply port 106*a* can be allowed to connect with the lock port 108 via the annular groove 104*h* by means of the land portion 104*c*. The second supply port 106*b* can be allowed to communicate with the retard port 101 via the annular groove 104*k* by means of the land portion 104*d*. The communication between the second supply port 106*b* and the advance port 102 is interrupted by the land portion 104*e*. The advance port 102 can be allowed to communicate with the drain port 107 via the annular groove 104*l* and the connecting port 104*p* by means of the land portion 104*e*. Therefore, the oil can be supplied to the lock grooves 21*k*, 21*l* of the first, second control mechanisms B1, B2 and the retard angle chamber R2. On the other hand, the oil can be drained from the advance angle chamber R1.

The above described hydraulic pressure control valve 100 according to the first embodiment of the present invention includes the ECU for controlling the exciting operation of the solenoid 103 based upon the predetermined control routine.

When starting the engine 1 that has been stopped, the electric current has not been supplied to the solenoid 103 of the hydraulic pressure control valve 100 by the ECU. Therefore, the spool 104 is maintained as illustrated in FIG. 5. The oil discharged from the oil pump 110 can be, supplied to the advance angle chamber R1 via the oil pressure circuit C. At, the same time, the oil can be drained from the first, second control mechanisms B1, B2, and the retard angle chamber R2 to the oil pan 120 via the oil pressure circuit C. Therefore, the advance angle chamber R1 is gradually filled with the oil. At the meantime, the first and second control mechanisms B1, B2, from which the oil has been drained, are operated to be locked. More specifically, when initially starting the engine 1, the rotor 21 is rotated in a retard direction relative to the housing 30 due to the variable torque applied from the cam shaft 10. Accordingly, when the phase of the rotor 21 relative to the housing 30 is positioned at the advance side relative to the intermediate phase position with the engine 1 being stopped, the rotor 21 is gradually rotated in the retard direction due to the variable torque so as to reach the intermediate phase position. The lock plates 61, 63 are opposed to the lock grooves 21*k*, 21*l* and are then inserted thereinto. Therefore, the rotation of the rotor 21 relative to the housing 30 can be restrained by the lock operation of the first, second control mechanisms B1, B2.

On the other hand, when the phase of the rotor 21 relative to the housing 30 is positioned at the retard side relative to the intermediate phase position, the rotor 21 is rotated in the advance angle direction corresponding to the oil filled into the advance angle chamber R1 so as to reach the intermediate phase position. The lock plates 61, 63 are opposed to the lock grooves 21*k*, 21*l* and are then inserted thereinto. Therefore, the rotation of the rotor 21 relative to the housing 30 can be restrained by the lock operation of the first, second control mechanisms B1, B2.

As described above, the phase of the rotor 21 relative to the housing 30 can be maintained at the intermediate phase position by firmly performing the lock operation of the first, second control mechanisms B1, B2.

When the rotor 21 is maintained at the intermediate phase position relative to the housing 30 by the lock operation of the first, second control mechanisms B1, B2, the vanes 23 can be rotated in response to the rotation of the rotor 21 due to the variable torque applied from the cam shaft 10. In this case, the volume of the advance angle chamber R1 filled with the oil (or being filled with the oil) is varied (especially decreased) by the rotated vanes 23 so as to vary (especially increase) the oil pressure level. The first fluid path for operating the first, second control mechanisms B1, B2 are defined, independently of an oil path (a second fluid path of the fluid pressure passage) for supplying the oil to the advance angle chamber R1 and for draining the oil therefrom. The variation of the oil pressure is hence not acted on the lock grooves 21*k*, 21*l*. Therefore, even when the oil is supplied to the advance angle chamber R1 when starting the engine 1, the lock plates 61, 63 can be prevented from being released due to the variable torque or can be prevented from being maintained under the released condition.

Therefore, according to the variable valve timing control apparatus of the first embodiment of the present invention, the phase of the rotor 21 relative to the housing 30 can be surely maintained at the intermediate phase position. Further, when starting the engine 1, the first, second control mechanisms B1, B2 can be prevented from being unlocked and the rotor 21 can be prevented from being rotated due to the variable torque applied from the cam shaft 10. Therefore, the noise caused due to the contact of the vanes 23 with the projections 31*d*, 31*e* can be avoided. Further, the phase of the cam shaft 10 relative to the crank shaft 2 can be maintained at a predetermined phase without being affected by the variation of the phase of the rotor 21 relative to the housing 30. Therefore, the starting performance of the engine 1 can be prevented from being degraded.

Figure 3:
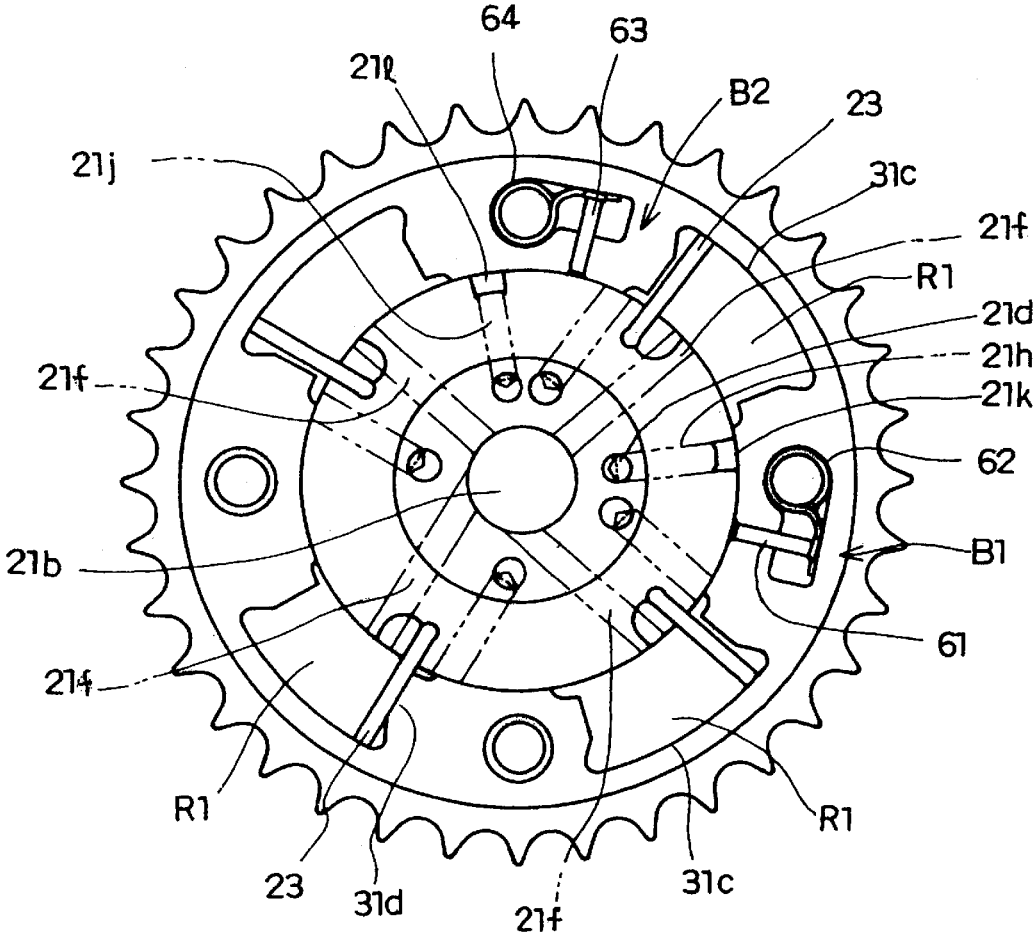
FIG. 3 is a cross-sectional view of the variable valve timing control apparatus under the most advanced angle condition according to the present invention.
Figure 4:
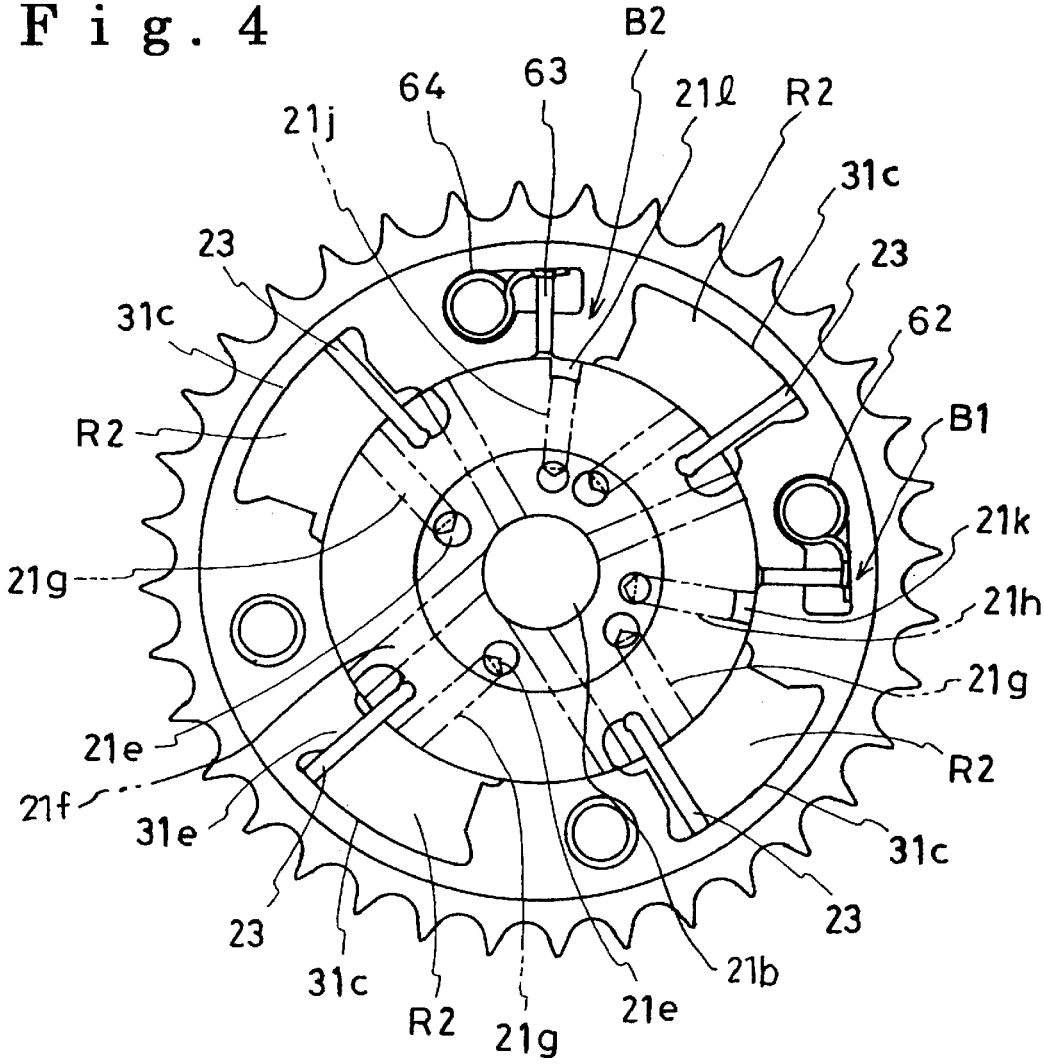
FIG. 4 is a cross-sectional view of the variable valve timing control apparatus under the most retarded angle condition according to the present invention.

As described above, the electric current supplied to the solenoid 103 can be controlled by the ECU based upon the predetermined control routine. Therefore, according to the first embodiment of the present invention, when the engine 1 is normally activated, the rotational phase of the rotor 21 relative to the housing 30 can be hence adjusted at a predetermined phase within a range between the most retarded angle phase, in which the volume of the advance angle chamber R1 is set at the minimum level and the volume of the retard angle chamber R2 at the maximum level as illustrated in FIG. 4, and the most advanced angle phase position, in which the volume of the retard angle chamber R2 is set at the minimum level and the volume of the advance angle chamber R1 at the maximum level as illustrated in FIG. 3. Therefore, when the engine 1 is activated, the valve opening/closing timing of the intake valve and the exhaust valve can be adjusted between the opening/closing operation under the most retarded angle condition and the opening/closing operation under the most advanced angle condition, when needed. When the rotor 21 is rotated in the advance angle direction, the hydraulic pressure control valve 100 is adjusted to be set as illustrated in FIG. 6 by supplying the solenoid 103 with the electric current having the duty ratio controlled by the ECU. When the rotor 21 is rotated in the retard direction, the hydraulic pressure control valve 100 is adjusted to be set as illustrated in FIG. 8 by supplying the solenoid 103 with the electric current having the duty ratio controlled by the ECU.

The hydraulic pressure control valve 100 is structured for supplying the oil to the first, second control mechanisms B1, B2 when the oil is supplied to one of the advance angle chamber R1 and the retard angle chamber R2. Therefore, the first, second control mechanisms B1, B2 are quickly unlocked when the rotor 21 is rotated in the advance angle direction or in the, retard direction, wherein the rotation of the rotor 21 relative to the housing 30 can be allowed. That is, the smooth operation of the variable valve timing control apparatus according to the first embodiment of the present invention can be assured without preventing the rotor 21 from being rotated.

Alternatively, the oil can be alternately supplied to the chambers R1 and R2 by alternately reciprocating the conditions of the hydraulic pressure control valve 100 illustrated in FIGS. 6, 8. Therefore, the oil can be supplied to both chambers R1, R2. In this case, the phase of the rotor 21 relative to the housing 30 can be smoothly shifted from the condition (a first condition) to be maintained at the intermediate phase position by the first, second control mechanisms B1, B2 to the other condition (a second condition) to be maintained at the intermediate phase position by the oil filled in the chambers R1, R2.

Hereinafter, the variable valve timing control apparatus according to a second embodiment of the present invention is described below. The variable valve timing control apparatus according to the second embodiment is different from the one according to the first embodiment with respect to the structure of a hydraulic pressure control valve 200. The same elements are denoted with the identical reference numerals employed by the first embodiment and the description thereof are omitted for simplifying the specification.

Figure 9:
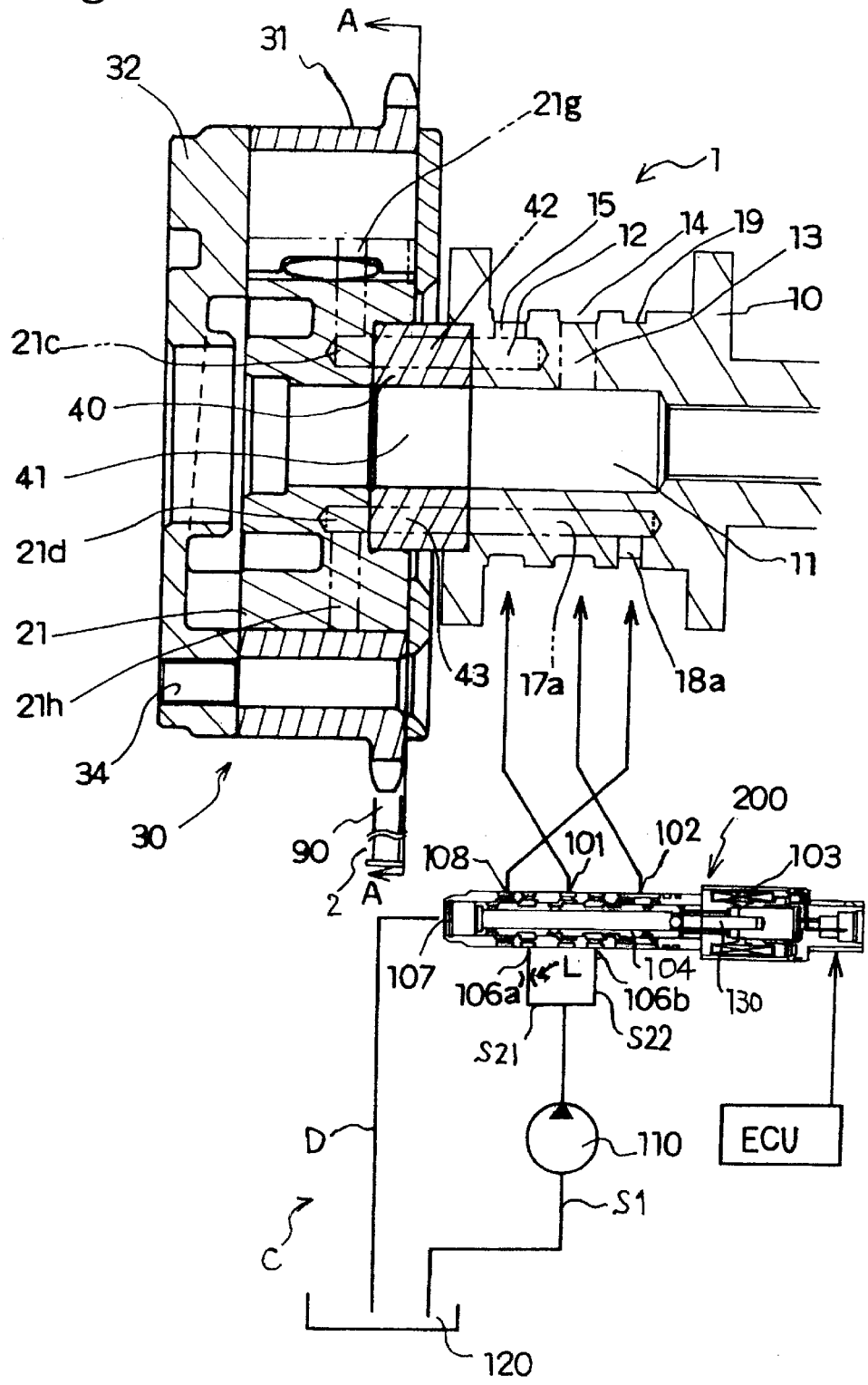
FIG. 9 illustrates an entire structure of the variable valve timing control apparatus according to a second embodiment of the present invention.

The hydraulic pressure control valve 200 illustrated in FIG. 9 forms the oil pressure circuit C having the oil pump 110 driven by the engine 1, the oil pan 120 thereof. Further, the hydraulic pressure control valve 200 is the variable electromagnetic spool valve for moving a spool 204 against the spring 105 in response to the electric current supplied to the solenoid 103 by the ECU. The ECU controls the duty value (%) of the electric current to be supplied to the solenoid 103 so as to change the stroke amount of the spool 204. Therefore, the hydraulic pressure control valve 200 is structured to control the fluid supplied to the advance oil path 11, the retard oil path 12, the first, second control mechanisms B1, B2 and the fluid drained therefrom.

Figure 10:
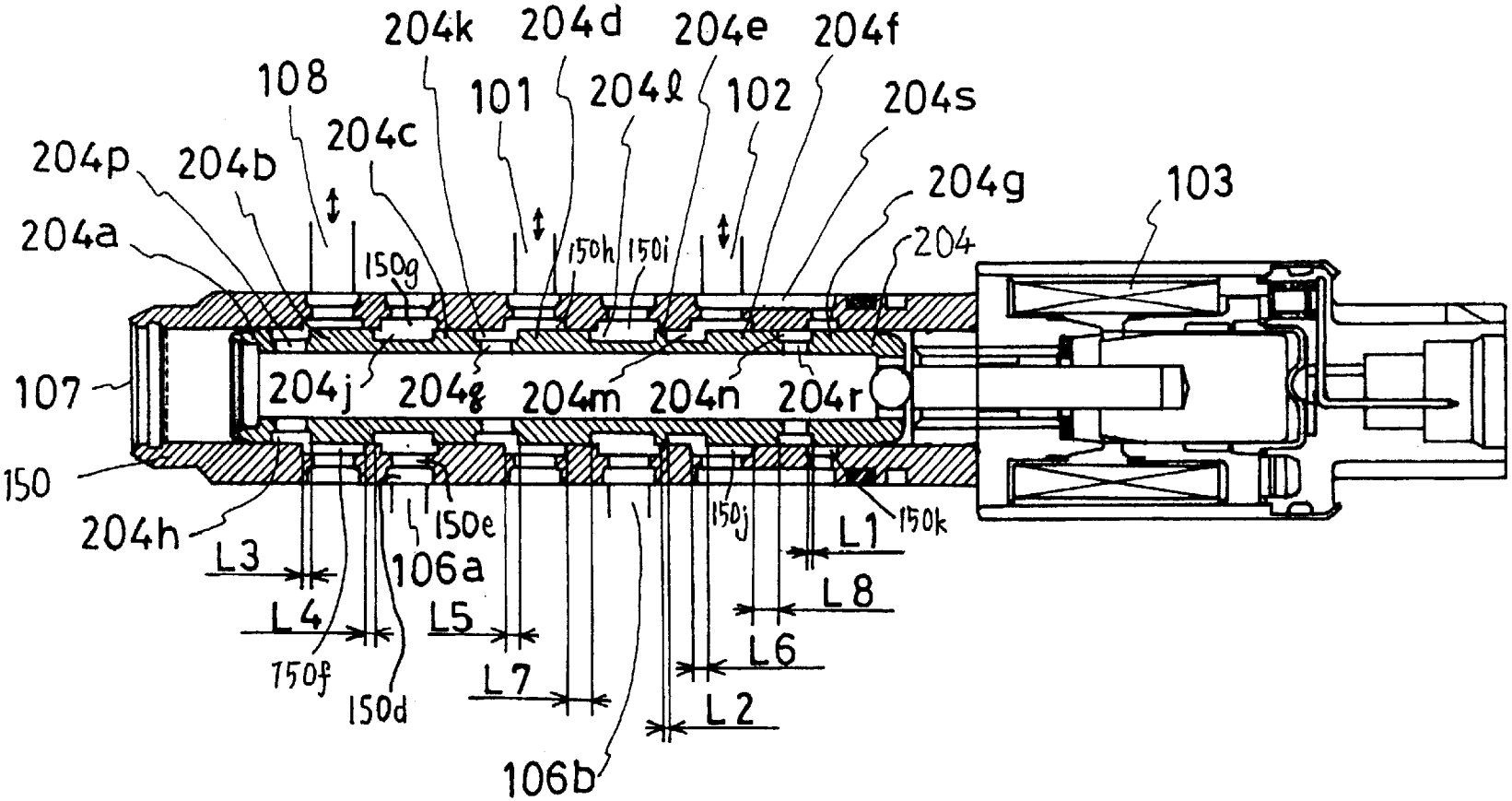
FIG. 10 is an enlarged view illustrating a first excited condition of a hydraulic pressure control valve according to the second embodiment of the present invention.

As being enlarged in FIG. 10, the spool 204 is provided with seven land portions 204*a*, 204*b*, 204*c*, 204*d*, 204*e*, 204*f*, 204*g*, six annular grooves 204*h*, 204*l*, 204*k*, 204*l*, 204*m*, 204*n*, six annular grooves 150*f*, 150*g*, 150*h*, 150*i*, 150*j*, 150*k*, and connecting ports 204*p*, 204*q*, 204*r*. Each annular groove 204*h*, 204*j*, 204*k*, 204*l*, 204*m*, 204*n* is defined between each land portion. Each connecting port 204*p*, 204*q*, 204*r* is defined for connecting each annular groove 204*h*, 204*k*, 204*n* with the drain port 107. A lap amount L1 between the annular grooves 204*n*, 150*k* is set to be equal to or smaller than a lap amount L2 between the annular grooves 150*i* and 204*m*. The lap amount L2 is set to be smaller than a lap amount L3 between the annular grooves 204*h*, 150*f*. The lap amount L3 is set to be equal to or smaller than a lap amount L4 between the annular grooves 150*f*, 204*j*. The lap amount L4 is set to be smaller than a lap amount L5 between the annular grooves 204*k*, 150*h*. The lap amount L5 is set to be equal to or smaller than a lap amount L6 between the annular grooves 204*m*, 150*j*. The lap amount L6 is set to be smaller than a lap amount L7 between the annular grooves 150*h*, 204*l*. The lap amount L7 is set to be equal to or smaller than a lap amount L8 between the annular grooves 150*j*, 204*n*. An annular groove 204*s* communicating with the advance port 102 is connected to the annular grooves 204*m* and 204*n*.

When the spool 204 is positioned as illustrated in FIG. 10, i.e. when the solenoid 103 is under the excited condition with the duty ratio of 0%, the communication between the first supply port 106*a* and the lock port 108 is interrupted by the land portion 204*b*. The communication between the second supply port 106*b* and the retard port 101 is interrupted by the land portion 204*d*, and yet the communication between the second supply port 106*b* and the advance port 102 is established by the land portion 204*e*. The lock port 108 can be allowed to communicate with the drain port 107 via the annular groove 204*h* and the connecting port 204*p* by means of the land portion 204*b*. The retard port 101 can be also allowed to communicate with the drain port 107 via the annular groove 204*k* and the connecting port 204*q* by means of the land portion 204*d*. The advance port 102 can be also allowed to communicate with the drain port 107 via the annular groove 204*n* and the connecting port 204*r* by means of the land portion 204*g*. Therefore, the oil can be drained from the retard port 101, the advance port 102, the lock port 108. Therefore, the oil can be drained from the lock grooves 21*k*, 21*l* of the first, second control mechanisms B1, B2, the retard angle chamber R2, and the advance angle chamber R1.

Figure 11:
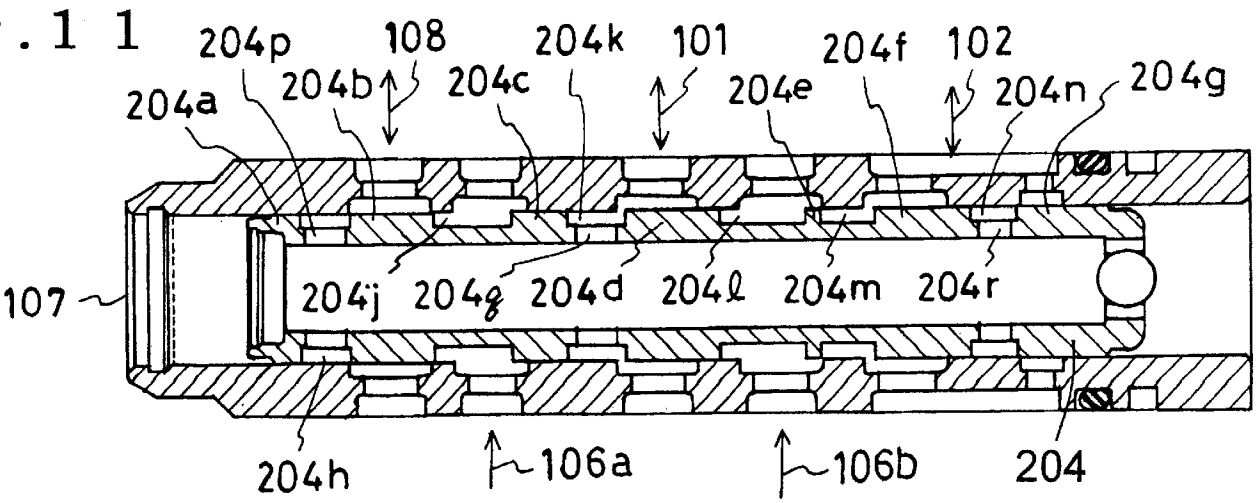
FIG. 11 is an enlarged view illustrating a second excited condition of the hydraulic pressure control valve according to the second embodiment of the present invention.

When the spool 204 is positioned as illustrated in FIG. 11, the communication between the first supply port 106*a* and the lock port 108 is interrupted by the land portion 204*b*. The lock port 108 can be allowed to communicate with the drain port 107 via the annular groove 204*h* and the connecting port 204*p* by means of the land portion 204*b*. The communication between the second supply port 106*b* and the retard port 101 is interrupted by the land portion 204*d*. The communication between the second supply port 106*b* and the advance port 102 can be established by the land portion 204*e*. The communication between the advance port 102 and the drain port 107 is interrupted by the land portion 204*g*. The retard port 101 can be allowed to communicate with the drain port 107 via the annular groove 104*k* and the communicating port 204*q* by means of the land portion 204*d*. Therefore, the oil can be supplied to the advance angle chamber R1. On the other hand, the oil can be drained from the lock grooves 21*k*, 21*l* of the first, second control mechanisms B1, B2 and the retard angle chamber R2.

Figure 12:
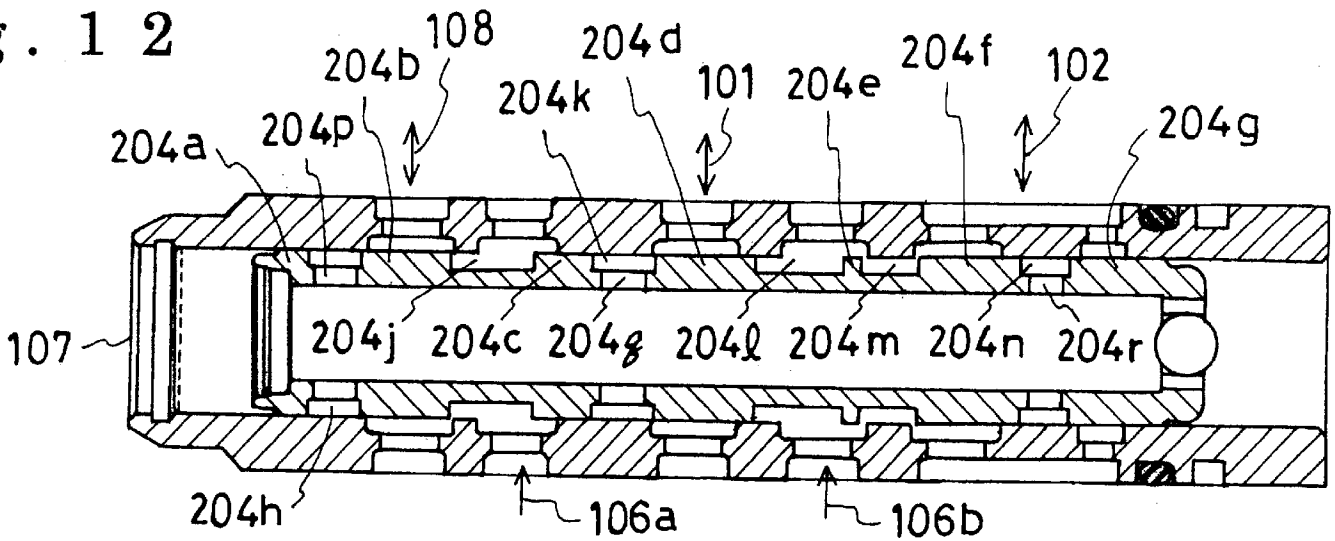
FIG. 12 is an enlarged view illustrating a third condition of the hydraulic pressure control valve according to the second embodiment of the present invention.

When the spool 204 is positioned as illustrated in FIG. 12, the communication between the first supply port 106*a* and the lock port 108 can be established by the land portion 204*b* and yet the communication between the first supply port 106*a* and the drain port 107 is interrupted thereby. The communication between the second supply port 106*b* and the retard port 101 is interrupted by the land portion 204*d*. The retard port 101 can be allowed to communicate with the drain port 107 via the annular groove 204*k* and the connecting port 204*q* by means of the land portion 204*d*. The advance port 102 can be allowed to communicate with the second supply port 106*b* via the annular grooves 204*l*, 204*m* by means of the land portion 204*e*. The communication between the advance port 102 and the drain port 107 is interrupted by the land portions 204*f*, 204*g*. Therefore, the oil can be supplied to the lock grooves 21*k*, 21*l* of the first, second control mechanisms B1, B2 and the advance angle chamber R1. On the other hand, the oil can be drained from the retard angle chamber R2.

Figure 13:
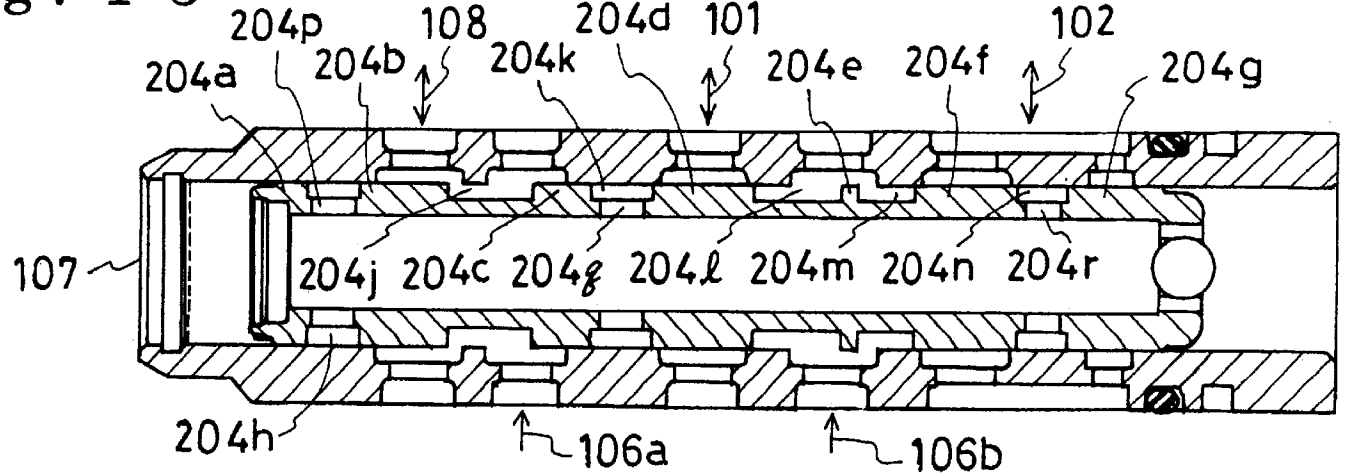
FIG. 13 is an enlarged view illustrating a fourth condition of the hydraulic pressure control valve according to the second embodiment of the present invention.

When the spool 204 is positioned as illustrated in FIG. 13, the communication between the first supply port 106*a* and the lock port 108 can be established by the land portion 204*b*. The communication between the second supply port 106*b* and the retard port 101 is interrupted by the land portion 204*d*. The communication between the second supply port 106*b* and the advance port 102 is also interrupted by the land portion 204*f*. The communication between the retard port 101 and the drain port 107 is interrupted by the land portion 204*d*. The communication between the advance port 102 and the drain port 107 is interrupted by the land portions 204*f*, 204*g*. Therefore, the oil can be supplied to the lock grooves 21*k*, 21*l* of the first, second control mechanisms B1, B2. The supply of the oil to the chambers R1, R2 and the drain of the oil therefrom can be interrupted.

Figure 14:
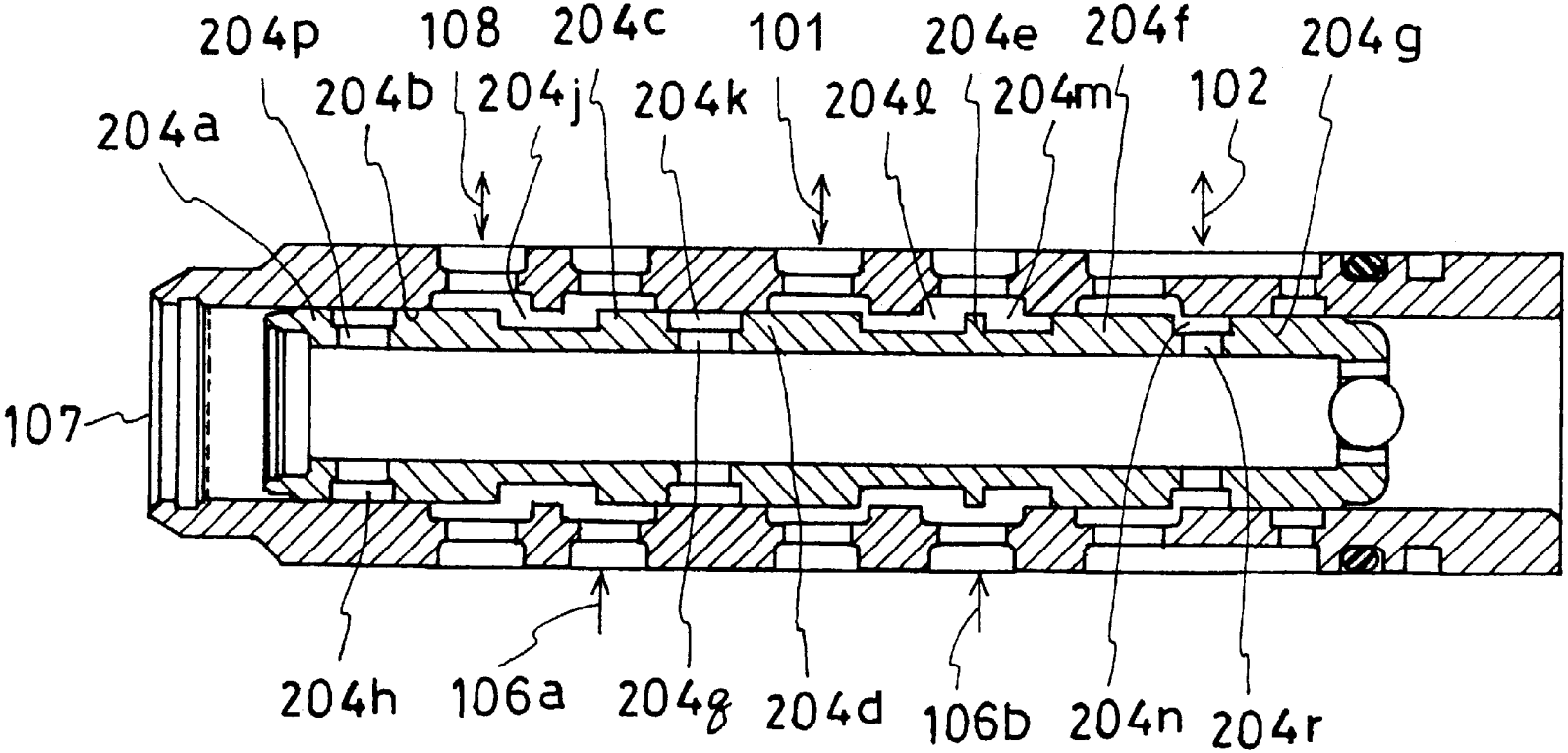
FIG. 14 is an enlarged view illustrating a fifth condition of the hydraulic pressure control valve according to the second embodiment of the present invention.

When the spool 204 is positioned as illustrated in FIG. 14, the communication between the first supply port 106*a* and the lock port 108 can be established by the land portion 204*b*. The retard port 101 can be allowed to communicate with the second supply port 106*b* via the annular groove 204*l* by means of the land portion 204*d*. The communication between the second supply port 106*b* and the advance port 102 is interrupted by the land portion 204*f*. The advance port 102 can be allowed to communicate with the drain port 107 via the annular groove 204*n* and the connecting port 204*r* by means of the land portion 204*f*. Therefore, the oil can be supplied to the lock grooves 21*k*, 21*l* of the first, second control mechanisms B1, B2 and the retard angle chamber R2. On the other hand, the oil can be drained from the advance angle chamber R1.

The above described hydraulic pressure control valve 200 according to the second embodiment of the present invention includes the ECU for controlling the exciting operation of the solenoid 103 based upon the predetermined control routine.

When starting the engine 1 that has been stopped, the electric current is not supplied to the solenoid 103 of the hydraulic pressure control valve 200 by the ECU. Therefore, the spool 204 is maintained as illustrated in FIG. 10. The, oil discharged from the oil pump 110 can not be supplied to the variable valve timing control apparatus by the hydraulic pressure control valve 200. At the same time, the oil can be drained form the first control mechanism B1, the second control mechanism B2, the advance angle chamber R1, the retard angle chamber R2 via the hydraulic circuit C. Therefore, the first, second control mechanisms B1, B2 are locked in response to the oil drained therefrom. In this case, the oil has been drained from the chambers R1, R2. Therefore, the rotation of the rotor 21 relative to the housing 30 can be performed smoothly by the variable torque applied from the cam shaft 10. When the rotational range of the rotor 21 relative to the housing 30 is increased when starting the engine 1 and when the phase of the rotor 21 relative to the housing 30 is positioned at the advance side of the intermediate phase position or at the retard side thereof, the phase of the rotor 21 relative to the housing 30 can be varied to the intermediate phase position due to the variable torque applied from the cam shaft 10. When the rotor 21 relative to the housing 30 is positioned at the intermediate phase position, the first, second control mechanisms B1, B2 can be accommodated in the lock grooves 21*k*, 21*l*. Therefore, the rotation of the rotor 21 relative to the housing 30 can be restrained. Further, the phase of the rotor 21 relative to the housing 30 can be maintained at the intermediate phase position.

According to the variable valve timing control apparatus of the second embodiment as well as the one of the first embodiment of the present invention, the rotor 21 can be maintained at the intermediate phase position by the first, second control mechanisms B1, B2. When the chambers R1 and R2 are filled with the oil, the volume of the advance angle chamber R1 or the retard angle chamber R2 is varied (especially decreased) by the vane 23 in response to the rotation of the rotor 21. Therefore, the oil pressure filled in the advance angle chamber R1 or the retard angle chamber R2 is varied (especially increased). However, the first fluid path for operating the first, second control mechanisms B1, B2 is defined independently of the second fluid path for supplying the oil to the advance angle chamber R1 and the retard angle chamber R2. Therefore, the oil pressure variation is not transmitted to the lock grooves 21*k*, 21*l*.

As described above, even when the oil is supplied to the advance angle chamber R1 or the retard angle chamber R2 upon starting the engine 1, the lock plates 61, 63 of the first, second control mechanisms B1, B2 can be prevented from being released due to the variable torque applied from the cam shaft 10. Further, the lock plates 61, 63 can be prevented from being maintained under the released condition, whereby the phase of the rotor 21 relative to the housing 30 can be assured at the intermediate phase position. Therefore, the noise caused by the variation of the phase of the rotor 21 relative to the housing 30 can be avoided. Therefore, the starting performance of the engine 1 can be prevented from being degraded.

According to the second embodiment, when the hydraulic pressure control valve 200 is set as illustrated in FIG. 10, the oil is drained from the advance angle chamber R1, the retard angle chamber R2, the first, second control mechanisms B1, B2 when starting the engine 1. Therefore, the phase of the rotor 21 relative to the housing 30 is operatively maintained at the intermediate phase position by the first, second control mechanisms B1, B2. On the other hand, when the hydraulic pressure control valve 200 is set as illustrated in FIG. 11, the phase of the rotor 21 relative to the housing 30 is maintained at the intermediate phase position by the oil filled in the advance angle chamber R1 or the retard angle chamber R2. When the hydraulic pressure control valve 200 is shifted from the condition illustrated in FIG. 10 to the other condition illustrated in FIG. 11, the first, second control mechanisms B1, B2 can be still maintained to be locked even while the oil has been supplied to the advance angle chamber R1 or the retard angle chamber R2. Therefore, the lock plates 61, 63 can be prevented from being disengaged from the lock grooves 21*k*, 21*l* due to the oil pressure variation when the sufficient oil has not been supplied to the advance angle chamber R1 or the retard angle chamber R2 (or both of the chambers R1, R2). In this case, the phase of the rotor 21 relative to the housing 30 can be prevented from being fluctuated when the phase holding by the locked first, second control mechanisms B1, B2 is shifted to the other phase holding by the oil supplied to the advance angle chamber R1 or the retard angle chamber R2.

As described above, the electric current supplied to the solenoid 103 is controlled by the ECU based upon the predetermined control routine. Therefore, according to the second embodiment of the present invention, when the engine 1 is normally activated, the rotational phase of the rotor 21 relative to the housing 30 can be hence adjusted at the predetermined phase within the range between the most retarded angle phase, in which the volume of the advance angle chamber R1 is set at the minimum level and the volume of the retard angle chamber R2 at the maximum level as illustrated in FIG. 4, and the most advanced angle phase, in which the volume of the retard angle chamber R2 is set at the minimum level and the volume of the advance angle chamber R1 at the maximum level as illustrated in FIG. 3. Therefore, when the engine 1 is activated, the valve opening/closing timing of the intake valve and the exhaust valve can be adjusted between the opening/closing operation under the most retarded angle condition and the opening/closing operation under the most advanced angle condition, when needed. When the rotor 21 is rotated in the advance angle direction, the hydraulic pressure control valve 200 is adjusted to be set as illustrated in FIG. 12 by supplying the solenoid 103 with the electric current having the duty ratio controlled by the ECU. When the rotor 21 is rotated in the retard direction, the hydraulic pressure control valve 100 is adjusted to be set as illustrated in FIG. 14 by supplying the solenoid 103 with the electric current having the duty ratio controlled by the ECU. When the phase of the rotor 21 relative to the housing 30 is maintained at the predetermined phase, the electric current having the controlled duty ratio is supplied to the solenoid 103 so as to set the hydraulic pressure control valve 200 as illustrated in FIG. 13. In this case, the oil can be supplied to the first, second control mechanisms B1, B2, wherein the lock plates 61, 63 are maintained under the released condition. Assuming that the phase of the rotor 21 is shifted from the actual position in the advance angle direction (or in the retard direction), the rotor 21 can be rotated smoothly by supplying the oil to the advance angle chamber R1 and the retard angle chamber R2.

When the oil is supplied to one of the advance angle chamber R1 and the retard angle chamber R2, the oil is also supplied to the first, second control mechanisms B1, B2. Therefore, Therefore, when the rotor 21 is rotated in the advance angle direction or in the retard direction, the first, second control mechanisms B1, B2 are unlocked. Therefore, the relative rotation of the rotor 21 can be performed smoothly without being blocked.

The unlock operation of the first, second control mechanisms B1, B2 can be performed independently of the oil supply to the chambers R1, R2. Therefore, the first, second control mechanisms B1, B2 can be unlocked after supplying the sufficient oil to the chambers R1, R2. Therefore, the variation of the phase of the rotor 21 can be prevented. Further, the first, second control mechanisms B1, B2 are not affected by the variable torque in each chamber R1, R2. Therefore, the locking operation and the releasing operation of the first, second control mechanisms B1, B2 can be prevented from being performed by mistake due to the variable torque.

According to the first, second embodiments of the present invention, the first, second control mechanisms (the relative rotation control mechanism) B1, B2 are unlocked when the oil is supplied to the lock grooves 21*k*, 21*l* and are locked when the oil is drained therefrom. Alternatively, the first, second control mechanisms B1, B2 can be unlocked when the oil is drained from the lock grooves 21*k*, 21*l* and can be locked when the oil is supplied thereto.

Further, according to the first embodiment of the present invention, the hydraulic pressure control valve 100 is shifted from the condition illustrated in FIG. 5 to the condition illustrated in FIG. 8 via the conditions illustrated in FIGS. 6, 7, in response to the electric current supplied to the solenoid 103. Alternatively, the hydraulic pressure control valve 100 can be set as illustrated in FIG. 8 when the electric current is not supplied thereto and can be shifted from the condition illustrated in FIG. 8 to the condition illustrated in FIG. 5 via the conditions illustrated in FIG. 7. 6.

Further, according to the second embodiment of the present invention, the hydraulic pressure control valve 200 is shifted from the condition illustrated in FIG. 10 to the condition illustrated in FIG. 14 via the conditions illustrated in FIGS. 11, 12, 13, in response to the electric current supplied to the solenoid 103. Alternatively, the hydraulic pressure control valve 200 can be set as illustrated in FIG. 14 when the electric current is not supplied thereto and can be shifted from the condition illustrated in FIG. 14 to the condition illustrated in FIG. 10 via the conditions illustrated in FIGS. 13, 12, 11.

Further, as illustrated in FIG. 1, an orifice L can be provided for the oil path S21 connecting the first supply port 106*a* and the oil pump 110. Accordingly, the oil pressure variation caused by the oil pump 110 can be prevented from being transmitted to the lock grooves 21*k*, 21*l* via the hydraulic pressure control valve 100. Therefore, the lock plates 61, 63 are prevented from repeatedly being engaged to the lock grooves 21*k*, 21*l* and disengaged therefrom due to the oil pressure variation. That is, the noise due to the repeated engaging/disengaging operations can be avoided. Further, the phase of the rotor 21 relative to the housing 30 can be prevented from not being assured by the first, second control mechanisms (the relative rotation control mechanism) B1, B2 due to the disengagement of the lock plates 61, 63. Further, the oil pressure variation caused by the volume variation in the advance angle chamber R1 in response to the rotation of the rotor 21, (i.e. the vane 23) is prevented from being transmitted to the lock grooves 21*k*, 21*l* via the second fluid path (the oil bore 21*f*, the central inner bore 21*b*, the axial oil path 41, the advance oil path 11, the oil paths 13, 14), the advance port 102 of the hydraulic pressure control valve 100 (or the hydraulic pressure control valve 200), an oil path (a fourth fluid path of the fluid pressure passage) defined by the annular groove 104*k* (or the annular groove 204*m*) in the hydraulic pressure control valve 100 (or the hydraulic pressure control valve 200), the second supply port 106*b*, the oil path S22, and the oil path S21. In the same manner, the oil pressure variation caused by the volume variation in the retard angle chamber R2 in response to the rotation of the rotor 21, i.e. the vane 23 is prevented from being transmitted to the lock grooves 21*k*, 21*l* via the second fluid path (the oil bores 21*g*, 21*c*, the oil path 42, the retard oil path 12, the oil paths 15, 16), the retard port 101 of the angle pressure control valve 100 (or the hydraulic pressure control valve 200), an oil path (the fourth fluid path) defined by the annular groove 104*k* (or the annular groove 204*l*) in the hydraulic pressure control valve 100 (or the hydraulic pressure control valve 200), the second supply port 106*b*, the oil path S22, and the oil path S21.

Therefore, the lock plates 61, 63 can be prevented from being repeatedly engaged with the lock grooves 21*k*, 21*l* and disengaged therefrom, wherein the noise due to the repeated engaging/disengaging operation can be avoided.

Further, the phase of the rotor 21 relative to the housing 30 can be prevented from not being assured by the relative rotation control mechanisms B1, B2 due to the disengagement of the lock plates 61, 63.

As described above, the orifice L can be applicable to both first and second embodiments. Although the orifice L is provided for the oil path S21 according to the first, second embodiments of the present invention, the orifice L can, be defined by partially diminishing a cross-sectional area of the oil path S21. Further, the oil path S21 can be defined by adjusting a width or length of the oil path 150*d* defined in the sleeve portion 150, the width or length of the oil paths 150*e*, 150*a* connecting the oil path 150*d* with the annular grooves 104*h*, 204*j*.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What we claim is:

1. A variable valve timing control apparatus, comprising:

a housing integrally rotated with one of a crank shaft of an internal combustion engine and a cam shaft thereof;

a rotor provided in the housing and integrally rotated with the other one of the crank shaft and the cam shaft;

a hydraulic chamber defined between the housing and the rotor;

a vane assembled in the rotor for dividing the hydraulic chamber into an advance angle chamber and a retard angle chamber;

a relative rotation control mechanism for restraining a relative rotation between the rotor and the housing at an intermediate phase position between the most advanced angle phase position and the most retarded angle phase position in response to a fluid supplied to the relative rotation control mechanism and a fluid drained therefrom; and a fluid pressure passage for controlling the fluid supplied to the advance angle chamber, the retard angle chamber, and the relative rotation control mechanism and for controlling the fluid drained therefrom, wherein the fluid pressure passage includes a first fluid path for supplying the fluid to the relative rotation control mechanism and for draining the fluid therefrom independently of a second fluid path for supplying the fluid to the advance angle chamber and the retard angle chamber and for draining the fluid therefrom;

wherein the fluid pressure passage further includes a hydraulic pressure control valve for supplying the fluid to the advance angle chamber, the retard angle chamber, and the relative rotation control mechanism and for draining the fluid therefrom, wherein the hydraulic pressure control valve includes a third fluid path for supplying the fluid to the relative rotation control mechanism and for draining the fluid therefrom independently of a fourth fluid path for supplying the fluid to the advance angle chamber and the retard angle chamber and for draining the fluid therefrom.

2. A variable valve timing control apparatus, according to claim 1, wherein the hydraulic pressure control valve drains the fluid from the advance angle chamber and the retard angle chamber.

3. A variable valve timing control apparatus, according to claim 2, wherein the hydraulic pressure control valve is controlled for supplying the fluid to the relative rotation control mechanism after supplying the fluid to at least one of the advance angle chamber and the retard angle chamber when the relative rotation of the rotor and the housing is shifted from a first condition to be maintained at the intermediate phase position by the relative rotation control mechanism to a second condition to be maintained at the intermediate phase position by a fluid pressure supplied to at least one of the advance angle chamber and the retard angle chamber.

4. A variable valve timing control apparatus, according to claim 1, wherein the first fluid path communicates with the relative rotation control mechanism via the cam shaft and the rotor, the second fluid path communicates with the advance angle chamber and the retard angle chamber via the cam shaft and the rotor, the third fluid path is defined in the hydraulic pressure control valve and communicates with the first fluid path, and the fourth fluid path is defined in the hydraulic pressure control valve and communicates with the second fluid path.

5. A variable valve timing control apparatus, according to claim 4, further comprising:

an oil pump driven by the internal combustion engine;

an oil pan for supplying the fluid to the relative rotation control mechanism, the advance angle chamber, and the retard angle chamber and for draining the fluid therefrom; and an oil pressure circuit for connecting the hydraulic pressure control valve with the oil pan via the oil pressure circuit, wherein the fluid is supplied to the relative rotation control mechanism from the oil pan via the oil pressure circuit, the third fluid path, and the first fluid path, the fluid is supplied to at least one of the advance angle chamber and the retard angle chamber from the oil pan via the oil pump, the fourth fluid path, and the second fluid path, the fluid is drained from the relative rotation control mechanism to the oil pan via the first fluid path, the third fluid path, and the oil pressure circuit, and the fluid is drained from at least one of the advance angle chamber and the retard angle chamber to the oil pan via the second fluid path, the fourth fluid path, and the oil pressure circuit, wherein the fluid is circulated between the oil pan and the relative rotation control mechanism, the advance angle chamber, the retard angle chamber.

6. A variable valve timing control apparatus, according to claim 5, further comprising:

an electronic control unit for controlling the hydraulic pressure control valve by supplying an electric current thereto;

the hydraulic pressure control valve including;

a solenoid to be excited with the electric current supplied by the electronic control unit; and a spool movable in response to the electric current supplied to the solenoid, wherein the third fluid path is connected to the first fluid path in response to the position of the spool for supplying the fluid to the relative rotation control mechanism, and the fourth fluid path is connected to the second fluid path in response to the position of the spool for supplying the fluid to at least one of the advance angle chamber and the retard angle chamber.

7. A variable valve timing control apparatus, according to claim 5, further comprising:

an orifice for preventing an oil pressure variation caused by the oil pump from being transmitted to the relative rotation control mechanism.

8. A variable valve timing control apparatus, according to claim 7, further comprising:

the oil pressure circuit including:

a first supply port for connecting the oil pump with the relative rotation control mechanism via the first and third fluid paths so as to supply the fluid to the relative rotation control mechanism; and a second supply port for connecting the oil pump with the advance angle chamber and the retard angle chamber so as to supply the fluid to at least one of the advance angle chamber and the retard angle chamber, wherein the orifice is provided for the first supply port for preventing an oil pressure variation caused by the oil pump from being transmitted to the relative rotation control mechanism.

9. A variable valve timing control apparatus, according to claim 7, wherein the orifice can be defined by reducing a partial cross-sectional area of the first supply port.

10. A variable valve timing control apparatus, comprising:

a housing integrally rotated with one of a crank shaft of an internal combustion engine and a cam shaft thereof;

a rotor provided in the housing and integrally rotated with the other one of the crank shaft and the cam shaft;

a hydraulic chamber defined between the housing and the rotor;

a vane assembled in the rotor for dividing the hydraulic chamber into an advance angle chamber and a retard angle chamber;

a relative rotation control mechanism for restraining a relative rotation between the rotor and the housing at an intermediate phase position between the most advanced angle phase position and the most retarded angle phase position in response to a fluid supplied to the relative rotation control mechanism and a fluid drained therefrom; and a fluid pressure passage which controls the fluid supplied to the advance angle chamber, the retard angle chamber, and the relative rotation control mechanism and the fluid drained therefrom, the fluid pressure passage including a first fluid path which supplies the fluid to the relative rotation control mechanism and drains the fluid therefrom independently of a second fluid path which supplies the fluid to the advance angle chamber and the retard angle chamber and drains the fluid therefrom, the fluid pressure passage further including a hydraulic pressure control valve which includes both a third fluid path and a fourth fluid path, with the third fluid path supplying the fluid to the relative rotation control mechanism and draining the fluid therefrom independently of the fourth fluid path which supplies the fluid to the advance angle chamber and the retard angle chamber and drains the fluid therefrom.

11. A variable valve timing control apparatus, according to claim 10, wherein the hydraulic pressure control valve which includes both the third fluid path and the fourth fluid path includes a spool slidably movable in a sleeve.

12. A variable valve timing control apparatus, comprising:

a housing integrally rotated with one of a crank shaft of an internal combustion engine and a cam shaft thereof;

a rotor provided in the housing and integrally rotated with the other one of the crank shaft and the cam shaft;

a hydraulic chamber defined between the housing and the rotor;

a vane assembled in the rotor for dividing the hydraulic chamber into an advance angle chamber and a retard angle chamber;

a relative rotation control mechanism for restraining a relative rotation between the rotor and the housing at an intermediate phase position between the most advanced angle phase position and the most retarded angle phase position in response to a fluid supplied to the relative rotation control mechanism and a fluid drained therefrom; and a fluid pressure passage for controlling the fluid supplied to the advance angle chamber, the retard angle chamber, and the relative rotation control mechanism and for controlling the fluid drained therefrom, wherein the fluid pressure passage includes a first fluid path for supplying the fluid to the relative rotation control mechanism and for draining the fluid therefrom independently of a second fluid path for supplying the fluid to the advance angle chamber and the retard angle chamber and for draining the fluid therefrom and a hydraulic pressure control valve for supplying the fluid to the advance angle chamber, the retard angle chamber, and the relative rotation control mechanism and for draining the fluid therefrom, and the hydraulic pressure control valve includes a third fluid path for supplying the fluid to the relative rotation control mechanism and for draining the fluid therefrom independently of a fourth fluid path for supplying the fluid to the advance angle chamber and the retard angle chamber and for draining the fluid therefrom, and the hydraulic pressure control valve is controlled for supplying the fluid to the relative rotation control mechanism after supplying the fluid to at least one of the advance angle chamber and the retard angle chamber when the relative rotation between the rotor and the housing is shifted from a first condition to be maintained at the intermediate phase position by the relative rotation control mechanism to a second condition to be maintained at the intermediate phase position by a fluid pressure supplied to at least one of the advance angle chamber and the retard angle chamber.

* * * * *